US005312022A

United States Patent [19]

Thompson et al.

[11] Patent Number: 5,312,022

[45] Date of Patent: May 17, 1994

[54] COMPENSATING NAIL-DRIVING CHUCK FOR PALLET-MAKING MACHINE

[75] Inventors: Terrence L. Thompson, Minneapolis, Minn.; Jack W. Gresham, Armuchee, Ga.

[73] Assignee: Viking Engineering & Development, Incorporated, Fridley, Minn.

[21] Appl. No.: 950,254

[22] Filed: Sep. 24, 1992

[51] Int. Cl.[5] ..... B27F 7/09

[52] U.S. Cl. ..... 227/130; 227/142

[58] Field of Search ..... 227/140, 142, 149, 110, 227/111, 66, 130; 173/101

[56] References Cited

U.S. PATENT DOCUMENTS

| | | | |
|---|---|---|---|
| 3,434,643 | 3/1969 | Wandel | 227/66 X |
| 3,625,305 | 12/1971 | Mueller et al. | 182/46 |
| 3,926,356 | 12/1975 | Still | 227/149 X |
| 4,573,623 | 3/1986 | Sexton, Jr. et al. | 227/66 |
| 4,782,989 | 11/1988 | Wallin et al. | 227/149 |
| 4,867,364 | 9/1989 | Wallin et al. | 227/7 |
| 5,058,795 | 10/1991 | Tonus | 227/111 X |
| 5,219,110 | 6/1993 | Mukoyama | 227/142 X |

*Primary Examiner*—Rinaldi Rada
*Attorney, Agent, or Firm*—Kinney & Lange

[57] ABSTRACT

A chuck device for driving nails into boards includes a nail-driving mechanism and a staging mechanism for positioning the nails to be driven by the nail-driving mechanism. A driving mechanism drives both the nail-driving mechanism and the staging mechanism for positioning the nails. A countersink control mechanism positioned between the staging mechanism and the driving mechanism provides the capability for selectively changing and fixing a distance between the staging mechanism and the driving mechanisms and a distance between the staging mechanism and the nail-driving mechanism.

9 Claims, 8 Drawing Sheets

54
56

130
57
128
132
14a
A
15
15b
134
15b
28a
28
66
64
62
63
60
69
76
50
36
71
38
B
73
40
68
78
70
82
44
84
75
86
86
80
C 54
56

130
57
128
132
A'
A
14a
15
134
15b
28a
28
66
64
62
63
60
69
76
D'
D
50
36
71
38
B
B'
73
40
68
78
70
82
44
84
75
86
C
C'
86
80

COMPENSATING NAIL-DRIVING CHUCK FOR PALLET-MAKING MACHINE

BACKGROUND OF THE INVENTION

The present invention relates to pallet-making machines in general, and in particular to nail-driving chucks for use in pallet-making machines.

The forerunners of today's wooden pallets were developed during World War II to assist the armed forces in moving large amounts of goods in short time periods with forklift trucks. Wooden pallet usage has increased explosively since that time.

Automated pallet-making machines were developed in response to the high demand for wood pallets and now occupy an important position in the pallet manufacturing industry. The primary function of these pallet-making machines is the automatic nailing of pallet boards which have been positioned either manually or with some assistance from the pallet-making machine.

Automated pallet-making machines often use drive pins or rams to drive nails being held by a chuck into boards located below the chuck. Nails driven into the component boards of a pallet must be countersunk so that the nail heads do not protrude above the top surface of the boards. Countersinking is important because bags or packages containing goods which are placed on pallets can be torn by nail heads protruding above the boards.

Depending upon the pallet buyer's specifications, pallet manufacturers countersink the top of the nails to different depths below the top surface of the pallet boards. This change in countersink depth has traditionally been made by changing the relative distance between the board end of the nailing chuck and the drive end of the nailing chuck so that the pin's final extended position of the nail-driving pin is changed relative to the board end of the nailing chuck.

An example of such a countersink adjustment apparatus is shown in the Wallin U.S. Pat. No. 4,782,989. In the Wallin patent the board end of the nailing chuck and the drive end of the nailing chuck are connected together by threads. The drive end of the nailing chuck contains female threads and the board end of the nailing chuck contains male threads. Where the drive end and the board end connect, a female threaded lock ring selectively locks the board end of the nailing chuck in position. The drive end of the nailing chuck is independently fastened in place so that the drive end cannot rotate about the longitudinal axis of the nailing chuck.

The board end of the chuck can be selectively rotated about the longitudinal axis of the nailing chuck while connected to the drive end of the chuck to change the relative distance from the board end of the chuck to the drive end of the chuck. The nail-driving pin is connected to the drive end of the chuck and extends into the board end of the chuck. When the distance from the board end of the chuck to the drive end of the chuck is changed, the position of the nail-driving pin, relative to the board end of the chuck, is also changed since the position of the nail-driving pin is fixed relative to the drive end of the chuck. Consequently, by changing the position of the board end of the chuck relative to the drive end of the chuck, the final extended position of the nail-driving pin can be adjusted relative to the board end of the chuck, and the nail countersink depth can be selectively changed.

One complication of this nail countersink depth adjustment method is that automatic nail feeding devices are often connected to the board end of the chuck. Since the board end of the chuck must be rotated to adjust the countersink depth, the automatic nail feeding device must be removed from the board end of the chuck prior to its adjustment and must be reattached following adjustment of the countersink depth. Since the automatic pallet-making machinery does not operate when the chuck is not operating, pallet making is suspended during the time required for removing and reattaching the automatic nail feeding equipment to the board end of the chuck and during the relatively short period of time required for actual adjustment of the board end of the chuck relative to the drive end of the chuck.

SUMMARY OF THE INVENTION

The present invention is a nailing chuck which uniformly drives and countersinks nails into boards and which possesses a mechanism for quickly changing the depth of nail countersink. The nailing chuck includes a nail-driving mechanism, a staging mechanism for positioning the nails to be driven, and a drive mechanism for driving the staging mechanism and for driving the nail-driving mechanism. The chuck also includes a countersink control mechanism for selectively changing and fixing the amount of nail countersink depth. The countersink depth is changed by changing the distance separating the drive mechanism and the staging mechanism, thereby changing the distance relationship between the nail-driving mechanism and the staging mechanism.

DETAILED DESCRIPTION OF THE PREFERRED EMBODIMENT

Figure 1:
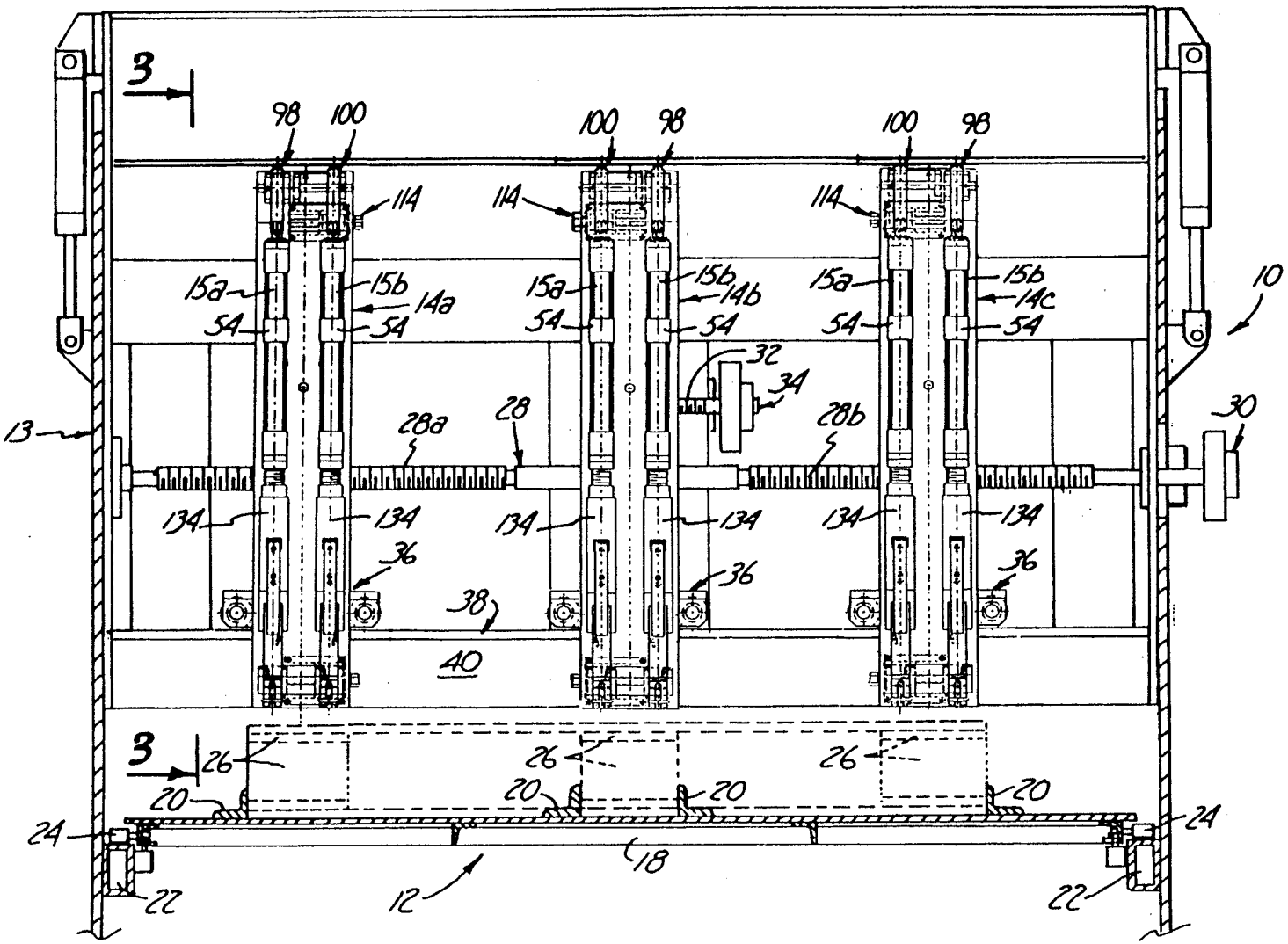
FIG. 1 is an elevational view of a nailing bridge of a pallet-making machine of the present invention.

A pallet-making machine is an automated machine which can reduce human labor required for pallet-making and which can increase pallet production rates. One example of an automated pallet-making machine is described in co-pending application assigned to the same assignee as the present application, entitled AUTOMATED NAILING DEVICE filed on even date herewith and hereby incorporated by reference. However, the present invention is suitable for use in any type of machine in which countersinking of nails is desirable. In the present invention a nailing bridge 10 illustrated in FIG. 1 is positioned above a pallet assembly conveyor 12. The nailing bridge 10, which is fixed in position and stationary, is situated generally perpendicular to the pallet assembly conveyor 12.

The nailing bridge 10 include a structural steel framework 13 which supports a left-hand nailing chuck support panel 14*a*, a central nailing chuck support panel 14*b*, a right-hand nailing chuck support panel 14*c*, and automatic nail feed equipment (not shown), located above the nailing chuck support panels 14*a*, 14*b*, 14*c*. Each nailing chuck support panel 14*a*, 14*b*, 14*c* includes a left-hand nailing chuck 15*a* and a right-hand nailing chuck 15*b*. Since each of the nailing chucks include like elements only one chuck will be described.

The pallet assembly conveyor 12 includes a pallet carriage 18, pallet board positioners 20, a conveyor chain drive mechanism 22, and a pallet carriage-conveyor chain drive mechanism linkage 24. During pallet-making cycles, various combinations of pallet boards 26 rest on the pallet carriage 18 utilizing the pallet board positioners 20. Positioning and movement of the pallet carriage 18 and actuation of the nailing chucks 15 is controlled by a microcomputer system (not shown).

During an operating cycle, the pallet carriage 18 moves in a machine direction until the microcomputer system (not shown) stops the pallet carriage 18 to position the pallet boards 26 under the nailing chucks 15 at a predetermined nailing position. The control system (not shown) then actuates the nailing chucks 15 to drive nails into the pallet boards 26. The nailing process is repeated until all top side pallet boards 26 are connected at the predetermined nailing position.

The pallet assembly conveyor 12 then moves the partially completed pallets into position above flippers (not shown) which flip the partially completed pallets so the previously nailed boards rest directly on the pallet carriage 18. The pallet assembly process then continues after additional pallet boards 26 are placed on the partially finished pallet to form the pallet's bottom. Following placement of the boards to form the pallet's bottom, the microcomputer control system (not shown) controls movement of the pallet carriage 18 beneath the nailing chucks 15*a* and 15*b* until all predetermined nailing positions on the pallet boards forming the bottom of the pallet are nailed.

All three nailing chuck support panels 14*a*, 14*b*, 14*c* move horizontally across the nailing bridge 10 in a direction transverse to the pallet assembly conveyor 12 direction of movement. The movement of the left-hand nailing chuck support panel 14*a* and the right-hand nailing chuck support panel 14*c* is guided by a threaded shaft 28 which is driven by an electric motor drive 30. The threaded shaft 28 has both left-hand end threads 28*a* and right-hand end threads 28*b*. The left-hand end threads 28*a* guide the horizontal movement of the left-hand nailing chuck support panel 14*a*, and the right-hand end threads 28*b* guide the movement of the right-hand nailing chuck support panel 14*c*. Since the left-hand end threads 28*a* and the right-hand end threads 28*b* oppose each other, the left-hand nailing chuck support panel 14*a* and the right-hand nailing chuck support panel 14*c* can only move toward or away from each other and cannot move in the same horizontal direction.

The movement of the central nailing chuck support panel 14*b* is controlled by a separate threaded shaft 32 which is driven by an electric motor drive 34. The travel direction of the central nail chuck support panel 14*b* is independent of the travel direction of the left and right-hand nailing chuck support panels 14*a*, 14*c*.

Figure 2:
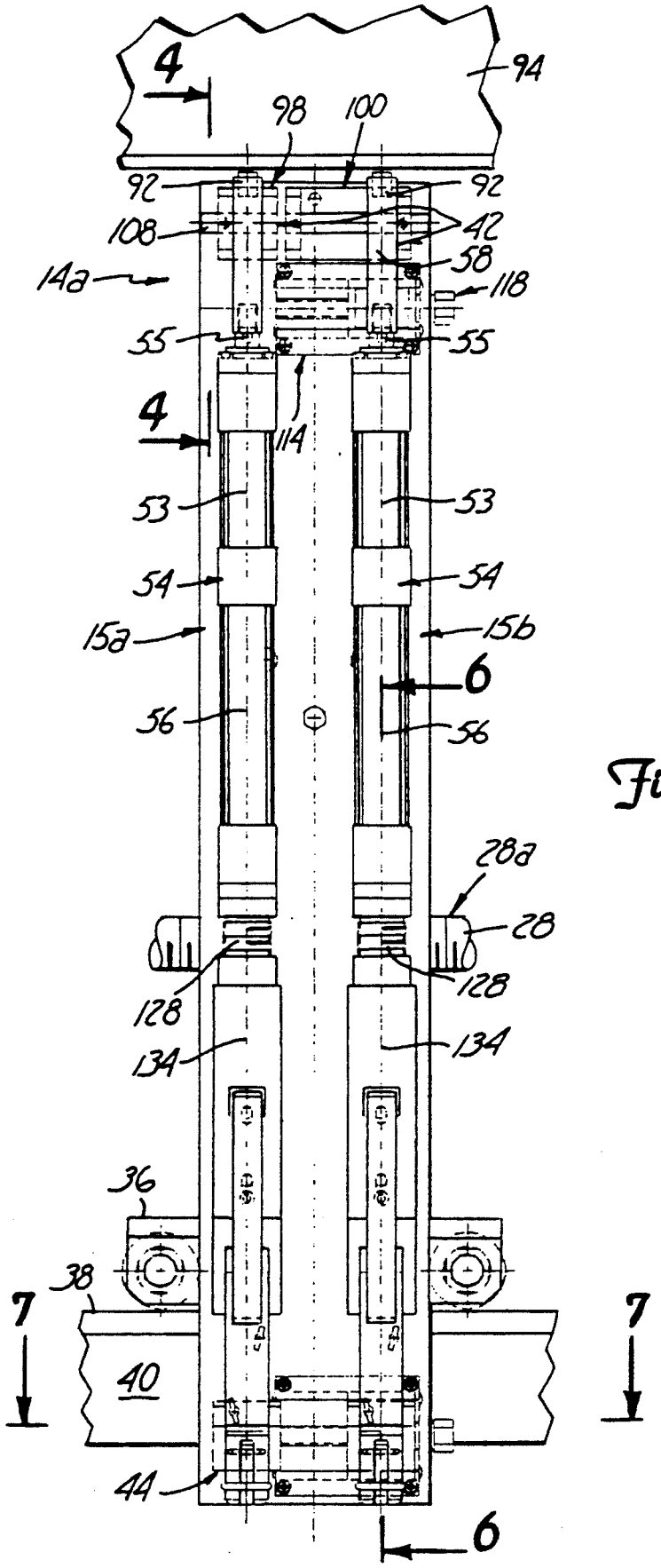
FIG. 2 is an enlarged, elevational view of a nailing chuck support panel and two attached nailing chucks of the present invention.

Only the left-hand nailing chuck support panel 14*a* illustrated in FIG. 2 will be described since the central and right-hand nailing chucks have identical elements. The chuck support panel includes a hanger assembly 42 that supports the weight of the left-hand nailing chuck 15*a* and the right-hand nailing chuck 15*b*. The left-hand nailing chuck support panel 14*a* also includes a securing assembly 44 for preventing rotation of the lower portion of the left-hand nailing chuck 15*a* and the right-hand nailing chuck 15*b*. The hanger assembly 42 and the securing assembly 44 are also used to change the relative lateral position of the left-hand nailing chuck 15*a* and the right-hand nailing chuck 15*b*.

A roller assembly 36 assists the threaded shaft 28 in supporting the weight of the left-hand nailing chuck support panel 14*a*. The roller assembly 36 also assists the threaded shaft 28 during horizontal movement of the left-hand nailing chuck support panel 14*a* by reducing frictional forces to smooth panel movement. The roller assembly 36 is welded to the back side of the left-hand nailing chuck support panel 14*a*. The nailing bridge 10 includes a horizontal structural member 40 that has a metal, rectangular roller path 38 on which the roller assembly 36 rides.

Figure 3:
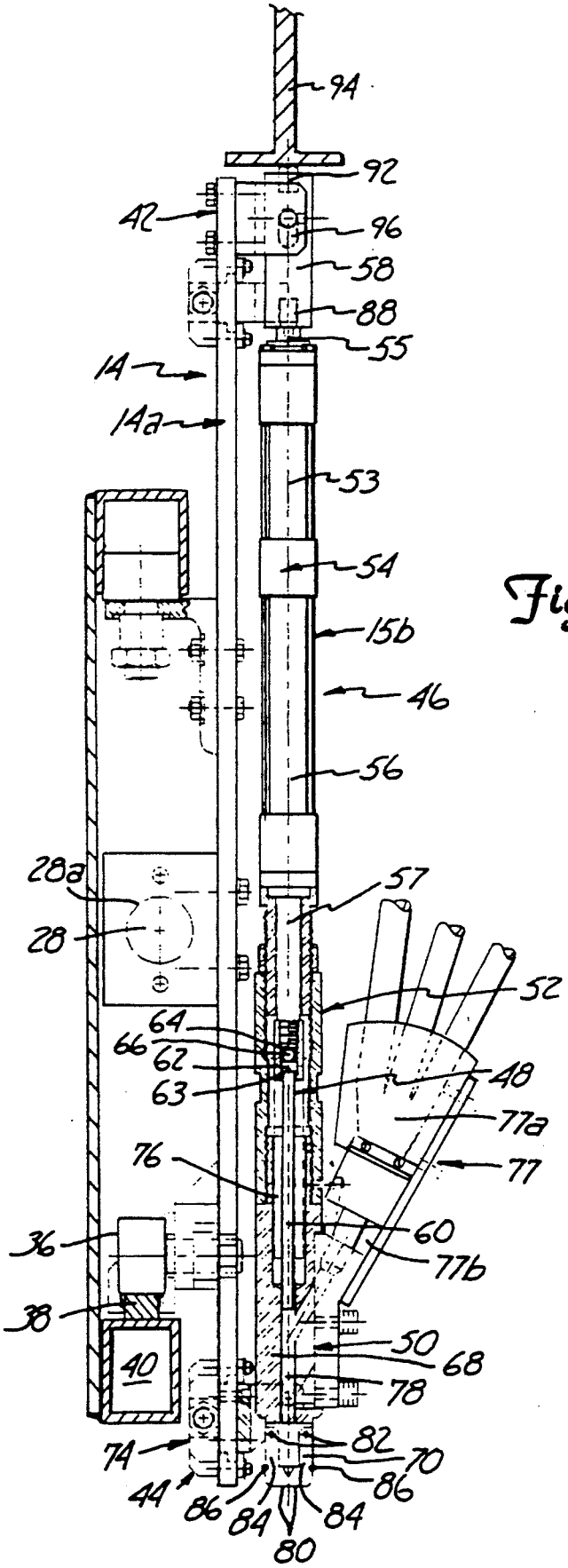
FIG. 3 is a sectional view taken along line 3—3 of FIG. 1.

The right-hand nailing chuck 15*b*, as illustrated in FIG. 3, includes the hanger assembly 42, a drive assembly 46, a nail-driving means such as structure 48, a nail staging assembly 50, and a countersink adjustment device 52. In the preferred embodiment, the drive assembly 46 includes a duplex hydraulic cylinder 54. The duplex hydraulic cylinder includes an upper cylinder 53 with an upper piston (not shown) and an upper piston rod 55 and a lower cylinder 56 with a lower piston (not shown) and a lower piston rod 57. A rod eye 58 is threadably attached to the piston rod 55 and a nail drive pin 60 is attached to the piston rod 57.

The upper cylinder 53 and the lower cylinder 56 are integrally mounted axially opposite each other so that the upper piston rod 55 and the lower piston rod 56 operate in opposite directions along a single axis. When the upper hydraulic cylinder 53 operates and pushes the upper piston (not shown) against the upper piston rod 55, the upper piston .rod 55 and the rod eye 58 remain predominantly stationary. The remainder of the right-hand nailing chuck 15*b*, including the upper cylinder 53 and the lower cylinder 56 of the duplex hydraulic cylinder 54 and all components below the duplex hydraulic cylinder 54, are driven toward the boards 26, until the right-hand nailing chuck 15*b* contacts the boards 26 and can move no farther downward. The function of the lower cylinder 56 is to drive the lower piston rod 57 and the nail drive pin 60 to the nail such that the nail is driven into the boards 26 touching the bottom of the right-hand nailing chuck 15*b*.

The upper end of the nail drive pin 60 has a head 62, which is positioned within a recess 63 in the bottom end of a drive pin connector 64. The drive pin connector 64 is female threaded and is screwed onto the male threads of the lower end of the lower piston rod 57. The nail drive pin 60 is disposed along the longitudinal axis of the duplex hydraulic cylinder 54. A ball bearing 66 is positioned within the drive pin connector 64 between the lower piston rod 57 and the nail drive pin 60. The ball bearing 66 functions to allow the nail drive pin 60 to spin around the same axis as the cylinder 54 when screwed nails are driven into the pallet boards 26.

Figure 6A:
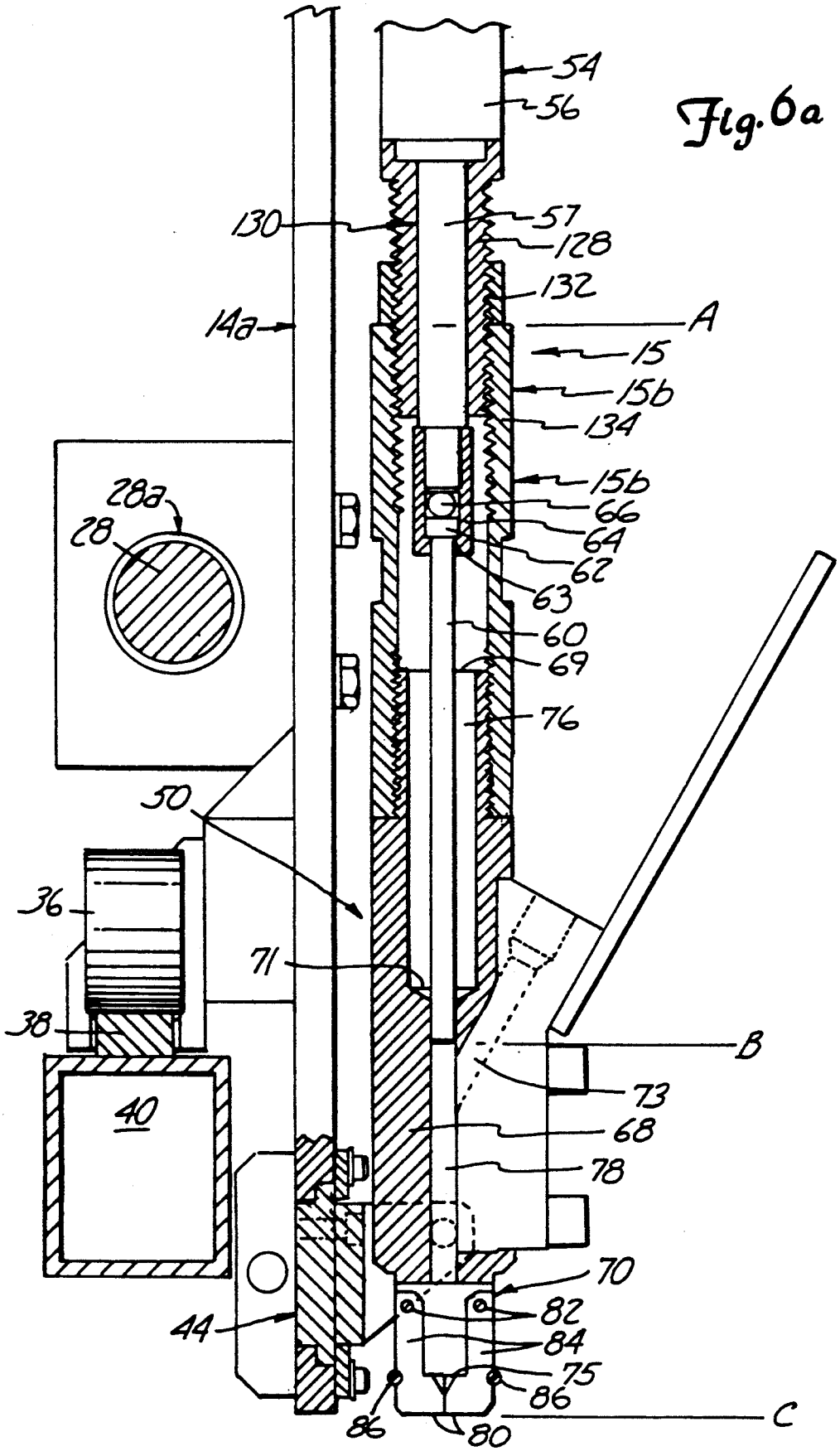
FIG. 6A is a sectional view taken along line 6—6 of FIG. 2 illustrating a fully retracted nail drive pin of a nailing chuck of the present invention at a selected countersink adjustment position.

The nail staging assembly 50 includes a staging body 68, a jaw nail stop 70, a nail feeder 72, and the securing assembly 44. The staging body 68 as best illustrated in FIG. 6A contains an upper cavity 76 and a diagonal nail entrance bore 73, which accepts nails from the nail feeder 72. The upper cavity 76 extends from an upper surface 69 of the staging body 68 to a point 71 immediately above the nail entrance bore 73. The diameter of the upper cavity 76 is slightly larger than the diameter of the drive pin connector 64. Therefore, the drive pin connector 64 can travel the full length of the upper cavity 76. The staging body 68 also includes an inner bore 78 located immediately below the upper cavity 76. The inner bore 78 is centered along with the upper cavity 76, on the same axis of travel of the lower piston rod 57 and the nail drive pin 60. The inner bore 78 extends from point 71 through a bottom surface 75 of the staging body 68.

The jaw nail stop 70 is attached to the bottom of the staging body 68 and includes a pair of chuck jaws 80 and a resilient O-ring 86. The chuck jaws 80 are pivotally mounted to the staging body 68 by roll pins 82 which are positioned within recesses 84 located in the lower end of the staging body 68. The chuck jaws 80 have their lower ends biased together by the resilient O-ring 86. The O-ring 86 causes the jaw nail stop 70 to remain closed until a nail being driven by the nail drive pin 60 forces the jaw nail stop 70 to spread, allowing the nail to enter between and pass through the chuck jaws 80.

Nail storage bins (not shown), and nail storage bin agitation equipment (not shown), nail feeder controllers (not shown), feed nails to nail delivery tubing **77*a* and local nail director 77 (shown in FIG. 3). The nail feeder 72 feeds one nail per nailing cycle to the nail staging assembly 50**.

Figure 4:
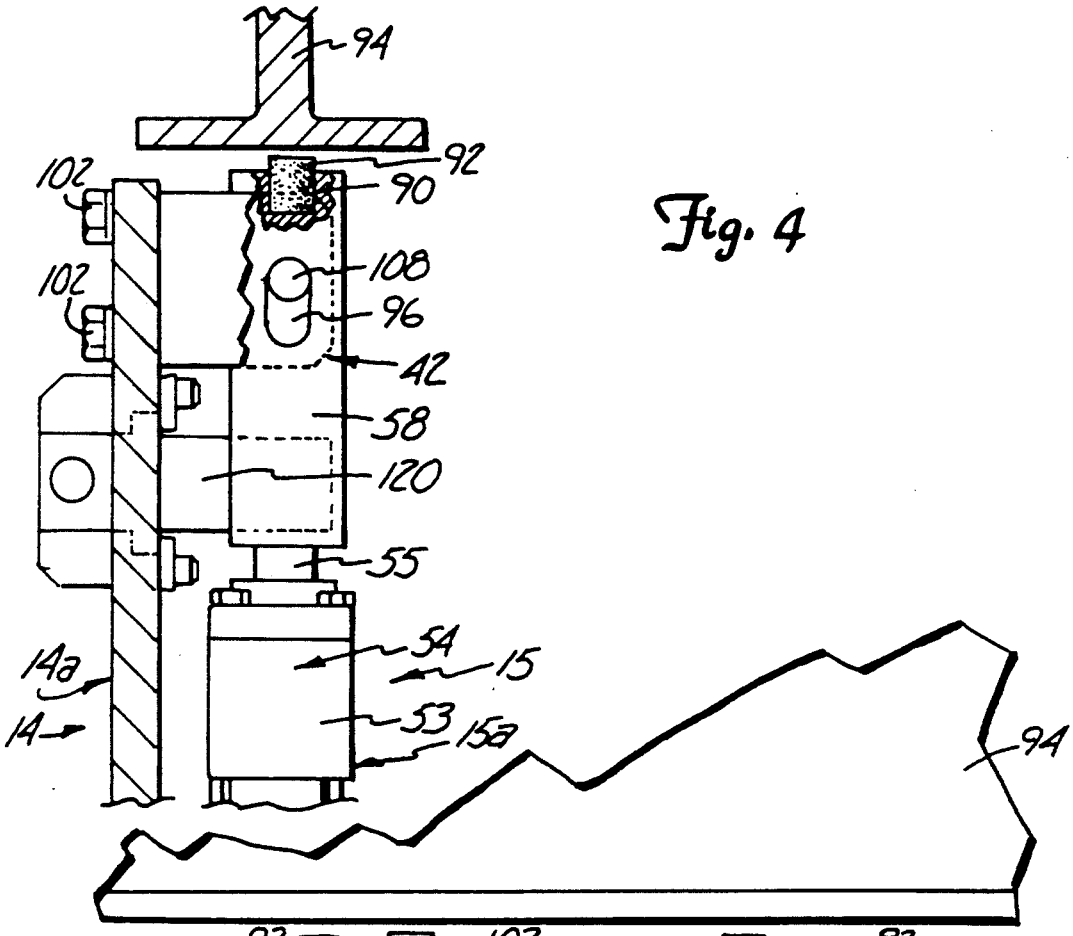
FIG. 4 is a sectional view taken along line 4—4 of FIG. 2.

The hanger assembly 42 as best illustrated in FIG. 4 supports the left-hand nailing chuck **15*a* and the right-hand nailing chuck 15*b*. The hanger assembly 42 also laterally positions either the left-hand nailing chuck 15*a* or the right-hand nailing chuck 15*b*. The rod eye 58 is preferably a rectangular bar of metal. As illustrated in FIG. 3, the lower end of the rod eye 58 has a female threaded bore 88 at a lower end which threadably engages a male threaded upper end of the upper piston rod 55. The rod eye 58 at an upper end contains a smooth bore 90 into which a short, cylindrical rubber bumper 92 is placed as illustrated in FIG. 4. The rubber bumper 92 reduces the amount of noise produced when the rod eye 58 is driven against a horizontal beam 94 of the nailing bridge 10. The rod eye 58 also contains a slot 96 extending the width of the rod eye 58**.

Figure 5:
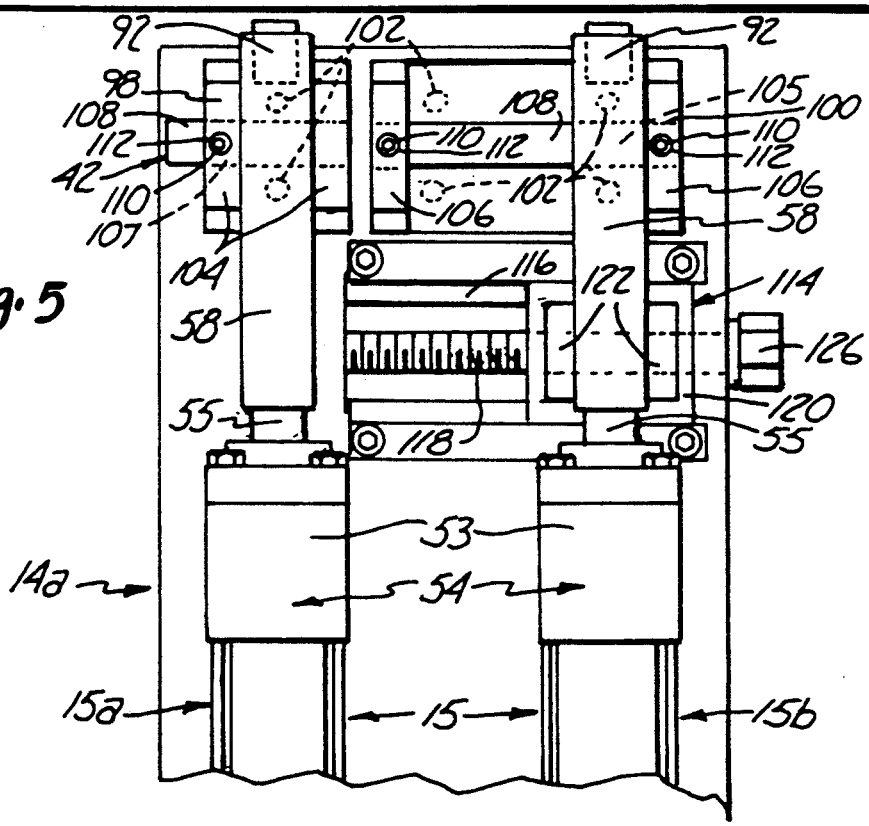
FIG. 5 is an enlarged fragmental view detailing the nailing chuck hanger assembly of the present invention.

The hanger assembly 42 includes a narrow channel bracket 98 and a broad channel bracket 100, both brackets mounted with screws 102 to the face of the left-hand nailing chuck support panel **14*a* as illustrated in FIG. 5. The narrow channel bracket 98 has two rectangular metal arms 104 which are spaced wider than the lateral width of the rod eye 58 such that the rod eye 58 fits between the arms 104 of the narrow channel bracket 98. The arms 104 of the narrow channel bracket 98 each contain a full-through transverse circular bore of similar diameter to that of the slot 96 of the rod eye 58**.

The broad channel bracket 100 has rectangular metallic arms 106. The arms 106 of the broad channel bracket 100 are spaced differently from the arms 104 of the narrow channel bracket 98. The arms 106 of the broad channel bracket 100 have circular bores 105 of the same diameter as circular bores 107 in the arms 104 of the narrow channel bracket 98. A hanger dowel 108 is sufficiently long so that the dowel fully traverses both the narrow channel bracket 98 and the broad channel bracket 100 with approximately one inch to spare. The diameter of the hanger dowel 108 is approximately the same as the diameter of the circular bores in the arms 104, 106 of the narrow channel bracket 98 and the broad channel bracket 100, respectively. Set pins 110 are threaded into set pin bores 112 and against the hanger dowel 108 to secure the hanger dowel 108.

On the left-hand nailing chuck support panel **14*a*, illustrated in FIG. 1, the narrow channel bracket 98 is located to the left of the broad channel bracket 100. Therefore, the right-hand nailing chuck 15*b* is movable laterally between the arms 106 of the broad channel bracket 100. On the central nailing chuck support panel 14*b* and on the right-hand nailing chuck support panel 14*c*, the narrow channel bracket 98 and the broad channel bracket 100 are reversed in position. On both the central nailing chuck support panel 14*b* and the right-hand nailing chuck support panel 14*c*, the broad channel bracket 100 is located to the left of the narrow channel bracket 98. Therefore, on the central nailing chuck support panel 15*b* and on the right-hand nailing chuck support panel 15*c*, the left-hand nailing chucks 15*a* are movable between the arms 106 of the broad channel bracket 100**.

Referring back to FIG. 5, the left-hand nailing chuck support panel **14*a* includes a lateral chuck positioning mechanism 114 for the right-hand nailing chuck 15*b* hanging from the hanger dowel 108 between the arms 106 of the broad channel bracket 100. The lateral chuck positioning mechanism 114 consists of a laterally-mounted metal channel 116 with a position adjustment screw 118 mounted laterally within the metal channel 116. A positioning bracket 120, with back and arms 122 wrapping around the back and sides of the rod eye 58, is attached to a threaded flange 124 which is threaded onto the position adjustment screw 118. Thereby, the head 126 of the position adjustment screw 118 can be gripped and rotated, allowing the right-hand nailing chuck 15*b* to be moved to any position between the arms 106 of the broad channel bracket 100**.

The position of the nail drive pin 60 is adjustable relative to the staging body 68 to change the amount of the nail countersink as illustrated in FIG. 6A. Male threaded sleeve 128 is bolted to the bottom of the duplex hydraulic cylinder 54, male threaded sleeve 128 having a bore 130 approximately the same as that of the lower piston rod 57. The top of the staging body 68 is also male threaded. The threads of the male threaded sleeve 128 are coarser than the male threads of the staging body 68. Lock nut 132, with the same coarse threading as the male threaded sleeve 128, is threaded onto the male threaded sleeve 128.

A countersink adjustment sleeve 134 has an internal cavity diameter equal to the outer diameter of threaded male sleeve 128 and the male threaded portion of the staging body 68. The countersink adjustment sleeve 134 has the same coarse threads as the male threaded sleeve 128 and the same fine threading as the staging body 68. The coarse threaded end of the countersink adjustment sleeve 134 is threaded onto the male threaded sleeve 128, and the fine threaded end of the countersink adjustment sleeve 134 is threaded onto the threaded end of the staging body 68.

The fine threaded end of the countersink adjustment sleeve 134 is tightened onto the staging body 68 until the end of the countersink adjustment sleeve 134 abuts into the nonthreaded lateral surface of the staging body 68. The coarse threaded end of the countersink adjustment sleeve 134 is also threaded several rounds onto the male threaded sleeve 128. The exact positioning of the countersink adjustment sleeve 134 on the male threaded sleeve 128 and staging body 68 is determined by the amount of countersink depth desired. The lock nut 132 is threaded down the male threaded sleeve 128 until the lock nut 132 abuts the upper end of the countersink adjustment sleeve 134. The lock nut is then tightened further against the countersink adjustment sleeve 134 to compress the coarse threads of the countersink adjustment sleeve 134 against the coarse threads of the male threaded sleeve 128 to maintain the selected countersink depth.

Figure 6B:
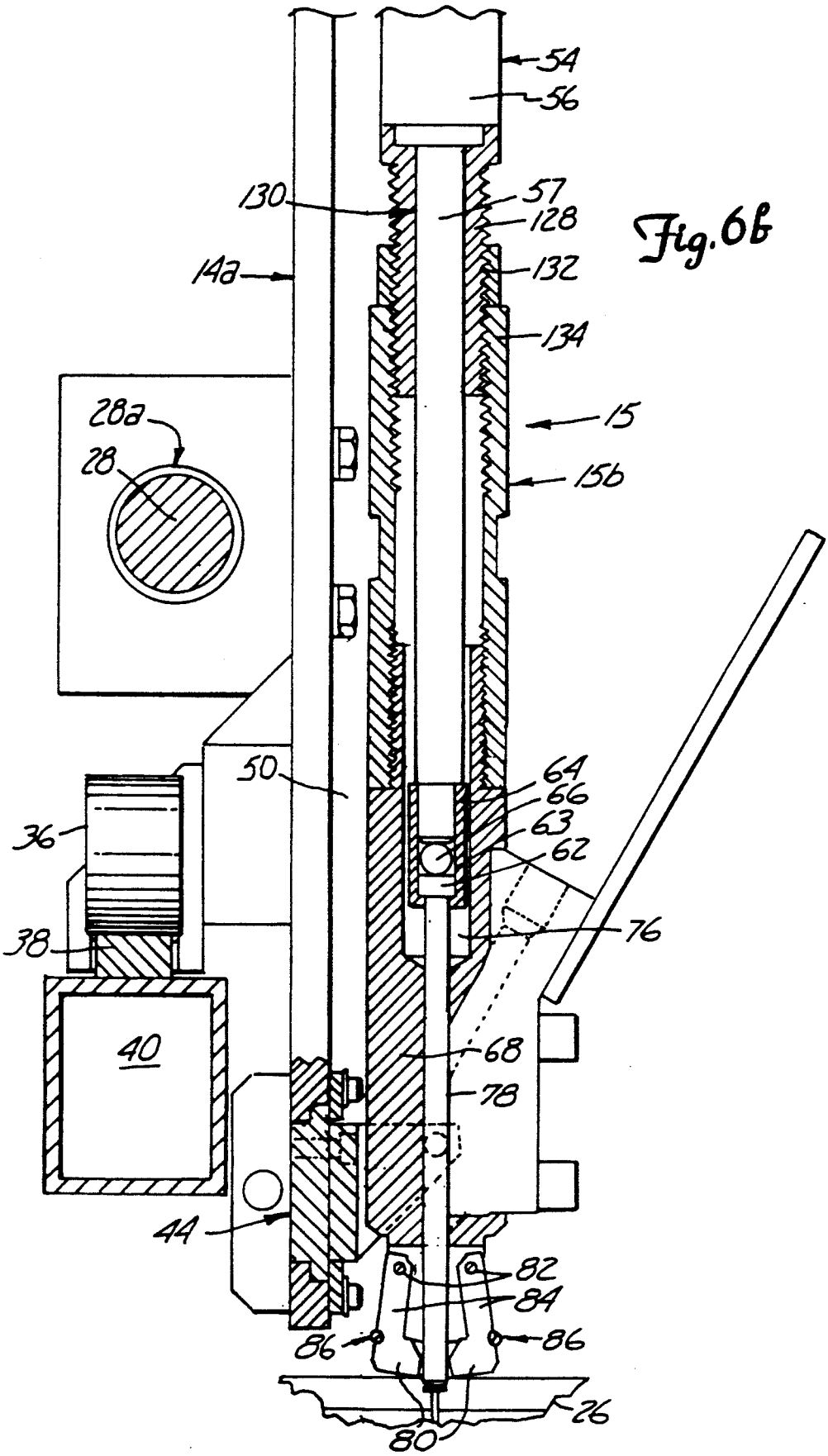
FIG. 6B is a sectional view taken along line 6—6 of FIG. 2 modified to illustrate the position of a nail drive pin of a nailing chuck of the present invention during a nail-driving cycle.
Figure 6C:
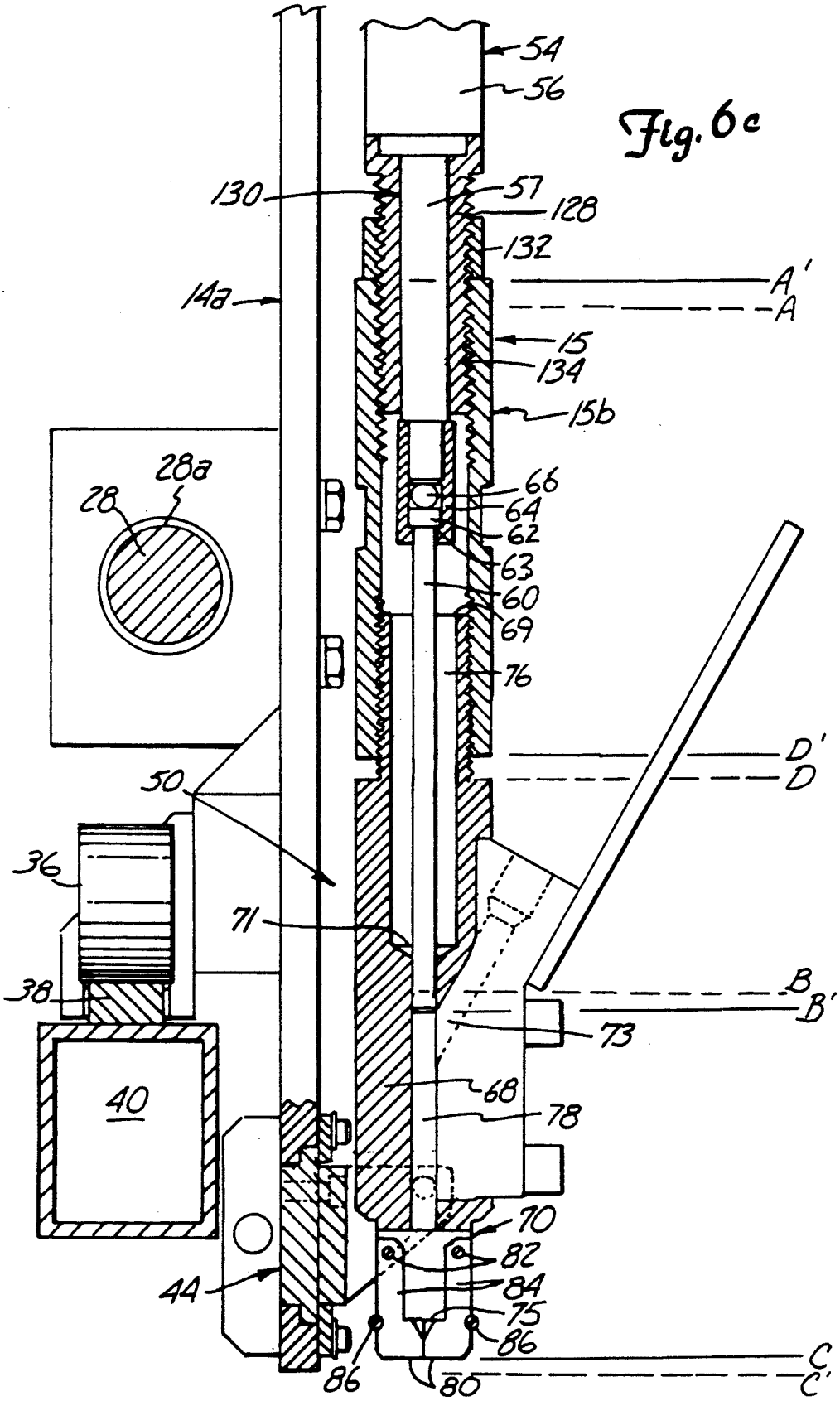
FIG. 6C is a sectional view taken along line 6—6 of FIG. 2 modified to illustrate a fully retracted nail drive pin of a nailing chuck of the present invention at a different selected countersink adjustment position.
Figure 8:
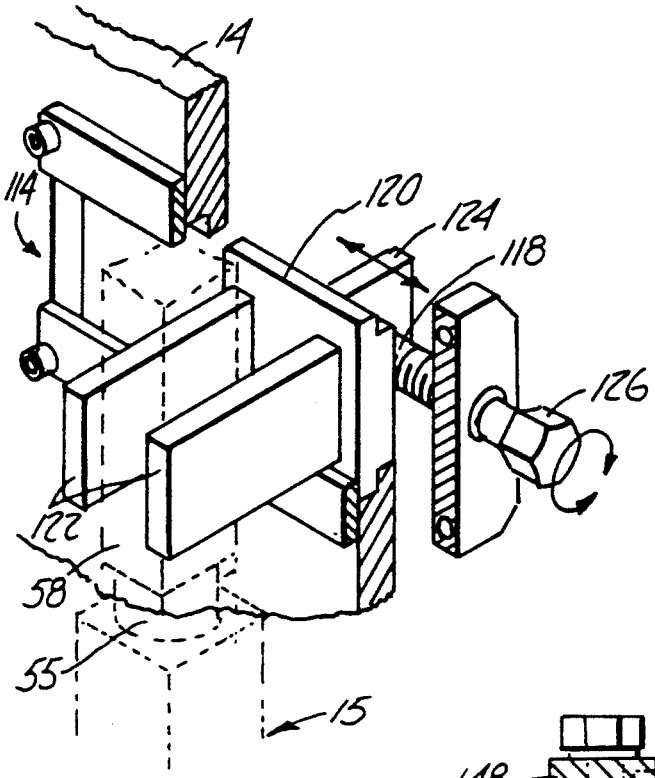
FIG. 8 is an exploded perspective view of the upper chuck lateral positioner of the present invention.

FIGS. 6A and 6C illustrate the change in position of the nail drive pin 60 with respect to the staging body 68 as the position of the countersink adjustment sleeve 134 is changed relative to the male threaded sleeve 128. FIGS. 6A and 6B illustrate the relative positions of the nail drive pin 60 relative to the staging body 68 prior to the nail-driving operation and when nail-driving is complete, respectively.

The operation of the right-hand nailing chuck 15*b* begins with the lower piston rod 57 fully retracted and in an uppermost position. In this position, the jaw nail stop 70 is spaced above the top surface of the pallet board 26 to be nailed and the chuck jaws 80 are in contact with each other at the bottom of the right-hand nailing chuck 15*b*, preventing the nail from passing through the jaw nail stop 70. Similarly, the drive pin connector 64 and the nail drive pin 60 are in a fully retracted, uppermost position. The staging body 68 along with the rest of the right-hand nailing chuck 15*b* are also in an uppermost retracted position.

When the microcomputer control system (not shown) triggers a nailing cycle, the upper piston rod 55 remains predominantly stationary as the upper hydraulic cylinder 53 pushes downward from the upper piston rod 55, thereby pushing the rest of the right-hand nailing chuck 15*b* structure downward toward the boards 26 to be nailed. As soon as the downward movement of the right-hand nailing chuck 15*b* is stopped, due to the jaw nail stop 70 contacting the board 26 to be nailed, the upper piston rod 55 and the rod eye 58 shift upward until the upward motion of the rod eye 58 and the upper piston rod 55 is stopped by engagement of the horizontal beam 94 of the nailing bridge 10. To this point, neither the nail drive pin 60, the drive pin connector 64, nor the lower piston rod 57 have moved relative to the chuck jaws 80 or the staging body 68.

Following the rod eye's 58 engagement of the horizontal beam 94 of the nailing bridge 10, the lower piston rod 57, the drive pin connector 64, and the nail drive pin 60 each begin to move downward relative to the chuck jaws 80 and the staging body 68. The nail drive pin 60 subsequently contacts the head of the nail to be driven and forces it through and out the jaw nail stop 70, forcing the chuck jaws 80 to spread as depicted in FIG. 6B. The drive pin 60 continues to drive the nail downward into the board 26 until the drive pin connector 64 reaches the bottom of the upper cavity 76 of the staging body 68.

The control system (not shown) reverses the cycle to retract the lower piston rod 57, and thus the nail drive pin 60, upward into the right-hand nailing chuck 15*b* and to retract the upper piston rod 55 into the upper cylinder 53 of the duplex hydraulic cylinder 54, thereby returning the right-hand nailing chuck 15*b* upward to its resting position.

FIGS. 6A and 6C in combination illustrate operation of the invention's countersink adjustment feature. The basic procedure is to change the distance relationship of the staging body 68 and the jaw nail stop 70 versus that of the nail drive pin 60. Reference characters A, B and C in FIGS. 6A and 6C illustrate positions of several nailing chuck components relative to the duplex hydraulic cylinder 54. Referring to FIG. 6A, reference character A indicates the position of the top of the countersink adjustment sleeve 134. Reference character B indicates the location of the lower end of the nail drive pin 60. Reference character C indicates the location of the bottom of the jaw nail stop 70.

Referring to FIG. 6C, the position of the countersink adjustment sleeve 134, relative to the duplex hydraulic cylinder 54, has been shifted upwards. This was done by unlocking the lock nut 132 and rotating the lock nut 132 upward on the male threaded sleeve 128 by at least the amount of distance presented by A' minus A. Next, the countersink adjustment sleeve 134 is rotated up the threaded male sleeve 128 from A to A'.

The male threads of the staging body 68 and the threaded male sleeve 128, as the two are situated in the right-hand nailing chuck 15*b*, rotate in the same direction. Therefore, as the countersink adjustment sleeve 134 is rotating up the threaded male sleeve 128, the countersink adjustment sleeve 134 is unscrewing off the staging body 68. However, since the threads on the upper end of the countersink adjustment sleeve 134 are coarse and the threads on the bottom end of the countersink adjustment sleeve 134 are fine, the staging body 68 and the jaw nail stop 70 do not move downward, relative to the countersink adjustment sleeve 134, the same absolute distance that the countersink adjustment sleeve 134 moves up the threaded male sleeve 128.

Instead, the staging body 68 and the jaw nail stop 70 move up a distance determined by subtracting the distance separating D and D' from the distance separating A and A'. This distance equals the distance between B and B'. Since the nail drive pin 60 remains steady with respect to the threaded male sleeve 128 and since the staging body 68 moves upward distance B—B' with respect to the threaded male sleeve 128, the nail drive pin 60 drops by distance B—B' with respect to the position of the staging body 68 and the jaw nail stop 70.

Position B, taken from FIG. 6A, illustrates the position of the end of the nail drive pin 60 with respect to the position of the staging body 68 before the movement of the countersink adjustment sleeve 134. B' represents the position of the end of the nail drive pin 60 relative to the staging body 68 after the upward adjustment of the countersink sleeve 134. Because the nail drive pin 60 has shifted downward relative to staging body 68, during any nail-driving cycles at this position of the countersink adjustment sleeve 134, the nail drive pin 60 will countersink nails distance B—B' deeper into the board 26 to be nailed than before the countersink adjustment sleeve 134 was adjusted from A to A'.

Figure 7:
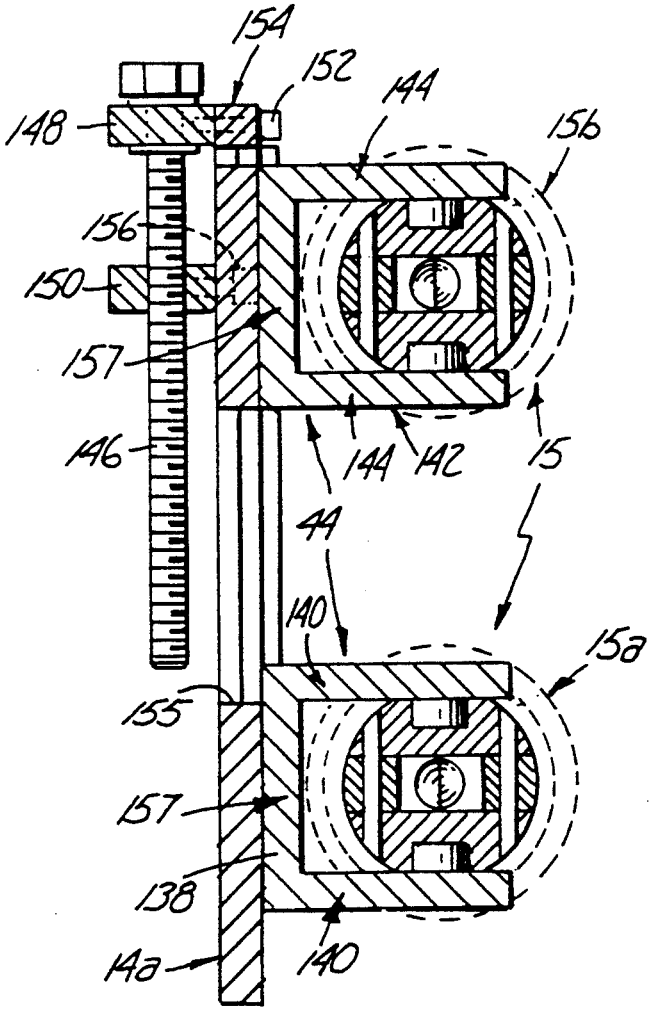
FIG. 7 is a sectional view taken along line 7—7 of FIG. 2.

FIG. 7 illustrates the securing assembly 44 which includes a stationary bracket 138 with two outwardly protruding arms 140 and a mobile bracket 142 with two outwardly protruding arms 144. The opposing lateral surfaces of the staging body 68 of the right-hand nailing chuck 15*b* has flat edges starting at the bottom of the staging body 68 and extending upward on the staging body 68 a distance which is slightly longer than the distance the upper piston rod 55 can travel. These flat surfaces on the staging body 68 fit between the arms 140 and 144 of stationary brackets 138 and mobile bracket 142 respectively and prevent the staging body 68 from rotating when the countersink adjustment sleeve 134 is adjusted to change the countersink depth.

FIG. 7 illustrates the relative positions of the stationary bracket 138 and the mobile bracket 142 on the left-hand nailing chuck support panel 14*a* on nailing bridge 10. On the central and right-hand side nailing chuck support panels 14*b*, 14*c* on nailing bridge 10, the relative positions of stationary and the mobile brackets 138 and 142 are switched; the stationary bracket 138 is located on the right-hand side and the mobile bracket 142 is located on the left-hand side.

With the right-hand nailing chuck 15*b* at its origination position on the left-hand nailing chuck support panel 14*a* and with the upper piston rod 55 in its retracted position—that is with a minimum amount of the upper piston rod 55 extending from upper cylinder 53—the stationary bracket 138 is attached to the left-hand nailing chuck support panel 14*a* near the bottom of the laterally opposing flat surfaces on the staging body 68. The stationary bracket 138 is laterally positioned such that the lateral flat surfaces of the staging body 68 fit comfortably between the arms 140 of the stationary bracket 138 so the lateral flat surfaces of the staging body 68 can slide up and down the vertical axis of the right-hand nailing chuck 15*b* without binding in the stationary bracket 138.

The mobile bracket 142 of the securing assembly 44 can be shifted horizontally to laterally reposition the bottom of the right-hand nailing chuck 15*b*. A positioning screw 146 includes a bushing 148 and a threaded nut 150. A screw 152 passes through a smooth bore 154 near the edge of the left-hand nailing chuck support panel 14*a*. The bore 154 is laterally opposite the position where the stationary bracket 138 is attached and is at a height on the left-hand nailing chuck support panel 14*a* such that the mobile bracket 142 will be at the same elevation as the stationary bracket 138 when the mobile bracket 142 is mounted. The screw 152 secures the positioning screw 146.

The mobile bracket 142 is fashioned like the stationary bracket 138. The arms 144 of the mobile bracket 142 square with the lateral flat surfaces of the staging body 68 to prevent binding as the staging body 68 slides up and down along the vertical axis of the right-hand nailing chuck 15*b*. The mobile bracket 142 also has a back wall 157 which connects the arms 144 together. The left-hand nailing chuck support panel 14*a* contains a rectangular hole 155 which is slightly shorter than the back wall 157 of the mobile bracket 142 and which is wide enough to accommodate lateral travel of the right-hand nailing chuck 15*b* along the full width of travel tolerated by broad channel bracket 100. A screw 156 connects the rear side of the mobile bracket 142 to a threaded bore located in the side of the threaded nut 150. Positioning of the upper and lower edges of the back wall of the mobile bracket 142 on the rear side of the rectangular hole contained in left-hand nailing chuck support panel 14*a* stabilizes the mobile bracket 142.

Rotation of the positioning screw 146 allows movement of the right-hand nailing chuck 15*b* positioned within the arms 144 of the mobile bracket 142 either toward or away from the left-hand nailing chuck 15*a* positioned between the arms 140 of the stationary bracket 138. Orientation of the movable right-hand nailing chuck 15*b* versus the stationary left-hand nailing chuck 15*a* at this lower securing assembly 44 is identical to that of the movable right-hand nailing chuck 15*b* versus the stationary left-hand nailing chuck 15*a* at the top of the left-hand nailing chuck support panel 14*a*.

With the countersink adjustment device 52 incorporated in the right and left-hand nailing chucks 15*a*, 15*b* in the present invention, quick changes in the nail countersink depth can be readily made. Because the adjustment can be made by simply rotating the countersink adjustment sleeve 134 after disengaging the lock nut 132, neither the nail staging assembly 50 nor the nail feed equipment 16 nor the nail feeder 72 need be disturbed or disconnected. The simplified adjustment may further increase productivity of automated pallet-making machinery.

Although the present invention has been described with reference to preferred embodiments, workers skilled in the art will recognize that changes may be made in form and detail without departing from the spirit and scope of the invention.

What is claimed is:

1. A chuck device for driving nails into boards wherein the chuck device is mounted to a chuck support frame, the chuck device comprising:

nail-driving means for driving nails along a path located on a nail driving axis into boards;

staging means for positioning the nails to be driven by the nail-driving means, the staging means attached to a lower end of the nail-driving means;

drive means for driving both the staging means and the nail-driving means, the drive means mounted to the chuck support frame;

countersink control means for selectively adjusting a distance between a surface of the boards and an upper surface of a head of a driven nail, the countersink control means adjustably engaging the nail-driving means and the drive means; and means for preventing rotational motion of the staging means about the nail driving axis while the distance between a surface of the boards and an upper surface of a head of a driven nail is being adjusted by the countersink control means, the means for preventing rotational motion engaging the staging means and being mounted to the chuck support frame.

2. The chuck device of claim 1 wherein the drive means comprises:

a first hydraulic cylinder with a first piston rod, the first piston rod attaching to the chuck support frame; and a second hydraulic cylinder with a second piston rod, the second piston rod adjustably engaging the countersink control means, wherein the second hydraulic cylinder is mounted adjacent to the first hydraulic cylinder such that the first piston rod and the second piston rod operate in opposing directions along the nail driving axis when the first and second hydraulic cylinders are actuated.

3. The chuck device of claim 2 wherein the nail-driving means includes a drive pin oriented along the nail driving axis and having a first end for engaging nail heads for driving, and having a second opposite end connected to an end of the second piston rod.

4. The chuck device of claim 3 wherein the nail-driving means further includes a ball bearing positioned between the second piston rod and the second opposite end of the driving pin and a connector for connecting the second piston rod and the second opposite end of the drive pin while securing the ball bearing between the second piston rod and the drive pin.

5. The chuck device of claim 4 wherein the staging means contains a cavity centered along a longitudinal axis of the staging means, the cavity being of sufficient size to allow the connector to travel along a portion of the longitudinal axis of the cavity, wherein the staging means further contains a bore located along the nail driving axis for orienting nails perpendicular to the boards and for containing the driving pin.

6. The chuck device of claim 5 and further comprising constructing jaw means, located at a distal end of the staging means nearest a board to be nailed for positioning a nail prior to driving the nail.

7. The chuck device of claim 5 and further comprising a coarsely male threaded sleeve fixedly positioned on the piston rod of the second hydraulic cylinder, wherein the staging means includes a finely male threaded end, wherein the countersink control means comprises an adjustment sleeve with a coarsely female threaded end for mating with the coarsely threaded male sleeve and a second finely threaded female end for mating with the threaded end of the staging means.

8. The chuck device of claim 7 wherein the countersink control means further includes a threaded lock nut positioned on the male threaded sleeve for locking the adjustment sleeve at a selected position relative to the male sleeve and staging means.

9. The chuck device of claim 1 wherein the means for preventing rotational motion includes at least one bracket mounted to the chuck support frame having a pair of spaced apart substantially flat faces, wherein the staging means includes a staging body with an outer surface having a pair of flat spaced apart faces, wherein the flat faces of the brackets contact the flat faces of the staging body to prevent rotational movement.

* * * * *

UNITED STATES PATENT AND TRADEMARK OFFICE

CERTIFICATE OF CORRECTION

PATENT NO. : 5,312,022

DATED : May 17, 1994

INVENTOR(S) : TERRENCE L. THOMPSON, JACK W. GRESHAM

It is certified that error appears in the above-identified patent and that said Letters Patent is hereby corrected as shown below:

Col. 2, line 64, delete "PREFERRED EMBODIMENT", insert --PREFERRED EMBODIMENTS--

Col. 11, line 24, delete "constructing", insert --constricting--

Signed and Sealed this

Thirteenth Day of September, 1994

*Attest:*

*Attesting Officer*

BRUCE LEHMAN

*Commissioner of Patents and Trademarks*